United States Patent [19]

Fischer

[11] Patent Number: 4,523,522

[45] Date of Patent: Jun. 18, 1985

[54] ROTARY PRINTING MACHINE WITH WEB TEAR CLEARING SYSTEM

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 552,730

[22] Filed: Nov. 17, 1983

[30] Foreign Application Priority Data

Nov. 27, 1982 [DE] Fed. Rep. of Germany ..... 3244045

[51] Int. Cl.[3] ..... B41F 5/04; B41F 13/28; B41F 13/32; B41F 13/34

[52] U.S. Cl. ..... 101/219; 101/247; 101/351; 101/352

[58] Field of Search ..... 101/209, 351, 352, 139, 101/140, 143, 144, 145, 182, 184, 218, 247, 219, 206, 207, 208, 349, 350, 363, 141, 142, 185

[56] References Cited

U.S. PATENT DOCUMENTS

| | | | |
|---|---|---|---|
| 3,095,810 | 7/1963 | Harris | 101/351 |
| 3,507,215 | 4/1970 | Schuhmann | 101/351 |
| 3,638,568 | 2/1972 | Granger | 101/352 |
| 3,789,757 | 2/1974 | Motter | 101/216 |
| 4,240,346 | 12/1980 | Landis | 101/351 |
| 4,290,360 | 9/1981 | Fischer | 101/352 |
| 4,385,559 | 5/1983 | Jarach | 101/352 |

FOREIGN PATENT DOCUMENTS 2156505 2/1973 Fed. Rep. of Germany .

*Primary Examiner*—Clyde I. Coughenour
*Assistant Examiner*—William L. Klima
*Attorney, Agent, or Firm*—Frishauf, Holtz, Goodman & Woodward

[57] ABSTRACT

To prevent introduction of paper scraps or torn paper into the inker of a web printing machine, a web paper tear sensor (17, 18) controls a hydraulic or pneumatic cylinder-piston unit (25) which severs engagement between an ink supply roller (13) and an ink application roller (12) while maintaining contact of the ink application roller with the plate cylinder (4) of the printing machine; the greater quantity of ink on the ink application roller will cause paper to adhere to the ink application roller, and thus wrap itself about that roller, severance of contact with the ink supply roller (13) preventing introduction of torn paper into the inker.

13 Claims, 3 Drawing Figures

ROTARY PRINTING MACHINE WITH WEB TEAR CLEARING SYSTEM

The present invention relates to web-type rotary printing machines, and more particularly to an apparatus to prevent difficulty from arising in the printing machine if the web on which printing is effected should tear.

BACKGROUND

Printing machines, and particularly high-speed rotary printing machines, may utilize apparatus which, upon detection of a tear of a web, typically a paper web, will recognize that the web is not being fed properly. A paper capturing device is then activated in order to pull out the paper which was torn from the printing stations. This apparatus prevents damage to the machine due to wrapping of torn paper about the cylinders of the printing machine. It has been found that, in complex printing machines, and particularly in multiple-station printing machines, it is possible that, in spite of paper capturing apparatus, the torn web can be led from the printing cylinders into the inker, and the respective rollers of the inking apparatus. It is a time-consuming and difficult task to clean the inker and remove any scraps or bits of paper therefrom. The inker must be practically completely cleaned if paper scraps are caught therein.

THE INVENTION

It is an object to improve rotary web printing machines such that, upon tears in the paper, entry of paper into the inker is effectively prevented.

Briefly, a sensor is provided which senses if the paper web tears; upon receiving a "torn paper" indication, the sensor so controls the position of an ink application roller that contact of the ink application roller with an adjacent milling roller or an ink transfer roller is interrupted, while contact of the ink application roller with the plate cylinder is maintained.

The system has the advantage that contamination of the respective rollers of the inking system, which are difficult to clean, is effectively prevented; only one roller within all the rollers of the system of the ink train will have paper thereon, which can be readily removed.

DRAWINGS

DETAILED DESCRIPTION

Figure 1:
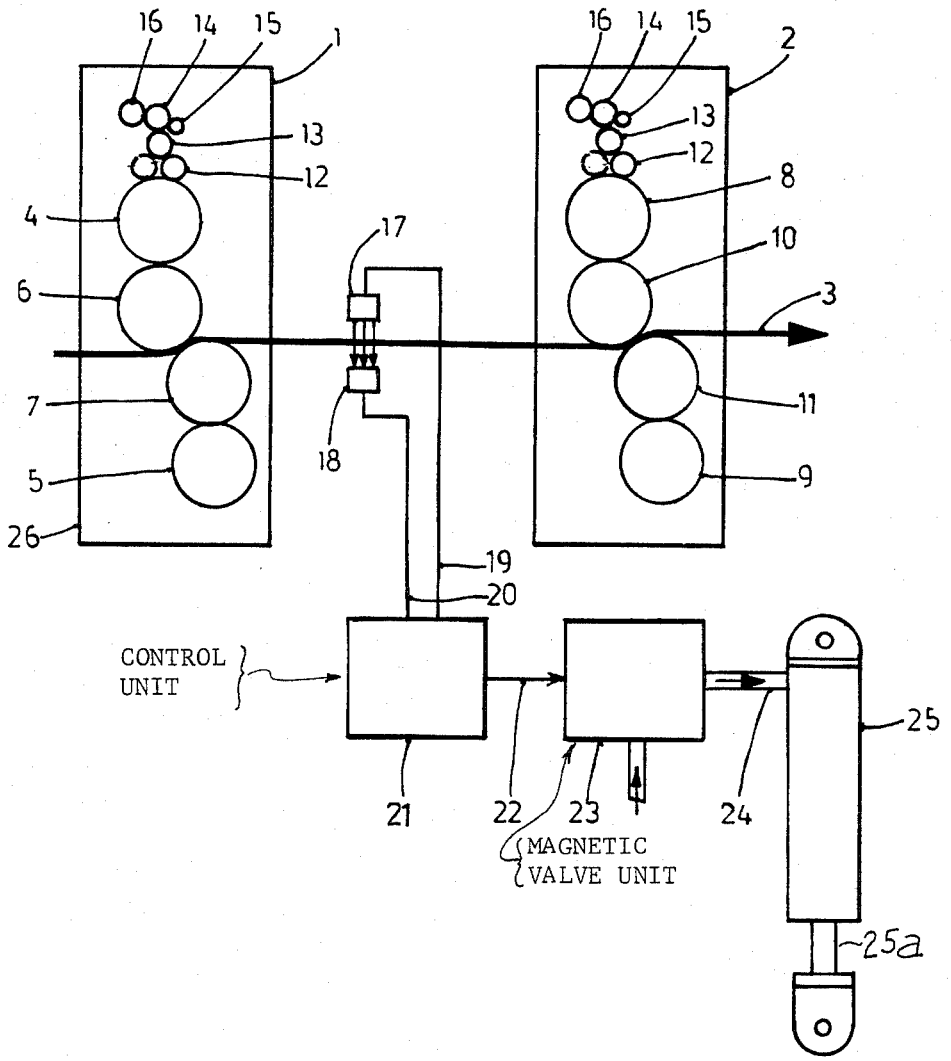
FIG. 1 is a high schematic side view of a rotary offset web-type printing machine, in which elements used in the present invention, are shown separately, and not to scale.

The printing machine has two printing stations or systems 1, 2 (FIG. 1) for printing on a web 3. Prime and verso printing, for example with two colors each, can be effected by the two printing systems 1, 2. Printing system 1 has two plate cylinders 4, 5, two rubber blanket cylinders 6, 7; the printing station 2 has two plate cylinders 8, 9 and two blanket cylinders 10, 11. Only the inkers associated with the upper plate cylinders 4, 8 are shown in the drawing for simplicity; similar inkers are associated, as well known, with the lower plate cylinders 5, 9. The dampers have been omitted from the drawing for simplicity of illustration.

Each one of the inkers has at least one ink application roller 12 which is in engagement with a milling roller 13.

The milling roller 13 receives ink from an ink transfer roller 14. A rider or idler roller 15 can be located in engagement with the transfer roller 14. A further ink transfer roller 16 can be provided, transferring ink to the transfer roller 14 and, in turn, receiving ink from a suitable ductor roller, from an ink trough, or the like—not shown in the drawings since the way ink is supplied to the milling roller 13 can be in accordance with any well known and standard arrangement. The milling roller may be axially oscillating.

A web tear sensor 17, 18 is located between the two printing stations 1, 2. Such a web tear sensor may, for example, include a source of radiation, typically a light source 17, which projects light towards a photo-sensitive pick-up 18. The paper web 3 is guided between the source 17 and the pick-up 18. If the paper should tear, for example an edge tear or the like, the quantity of light impinging on the pick-up 18—which may extend transversely across the web 3—will change from that to which the pick-up 18 is exposed if the web has maintained its integrity. The pick-up 18 then will respond by changed electrical current or voltage supplied through lines 19, 20 to a conrtrol circuit 21. Change in current or voltage on the lines 19, 20 is evaluated in the control unit 21 which, for example, may include a relay or transistor circuit changing switching state upon change in current or voltage on the lines 19. 20. The control 21 has an output control line 22 which is conducted to a valve unit 23. The valve may be a pneumatic or hydraulic valve, for example electromagnetically controlled by the line 22, to provide hydraulic or pneumatic fluid to a piston-cylinder unit 25. For example, upon change in signal current on lines 19, 20, the control unit 21 will provide a power output on line 22, to a magnetic valve in magnetic valve unit 23 to admit pressurized fluid through a fluid line 24 to the upper portion of a cylinder which includes a piston therein of the cylinder-piston unit 25.

OPERATION

Upon sensing of paper tearing, the piston-cylinder unit 25 and a piston therein will cause change in position of a respective piston rod and coupling element 25*a*, by causing extension or retraction thereof. If only a single line like line 24 is provided, retraction can be effected under spring force, as well known.

Figure 2:
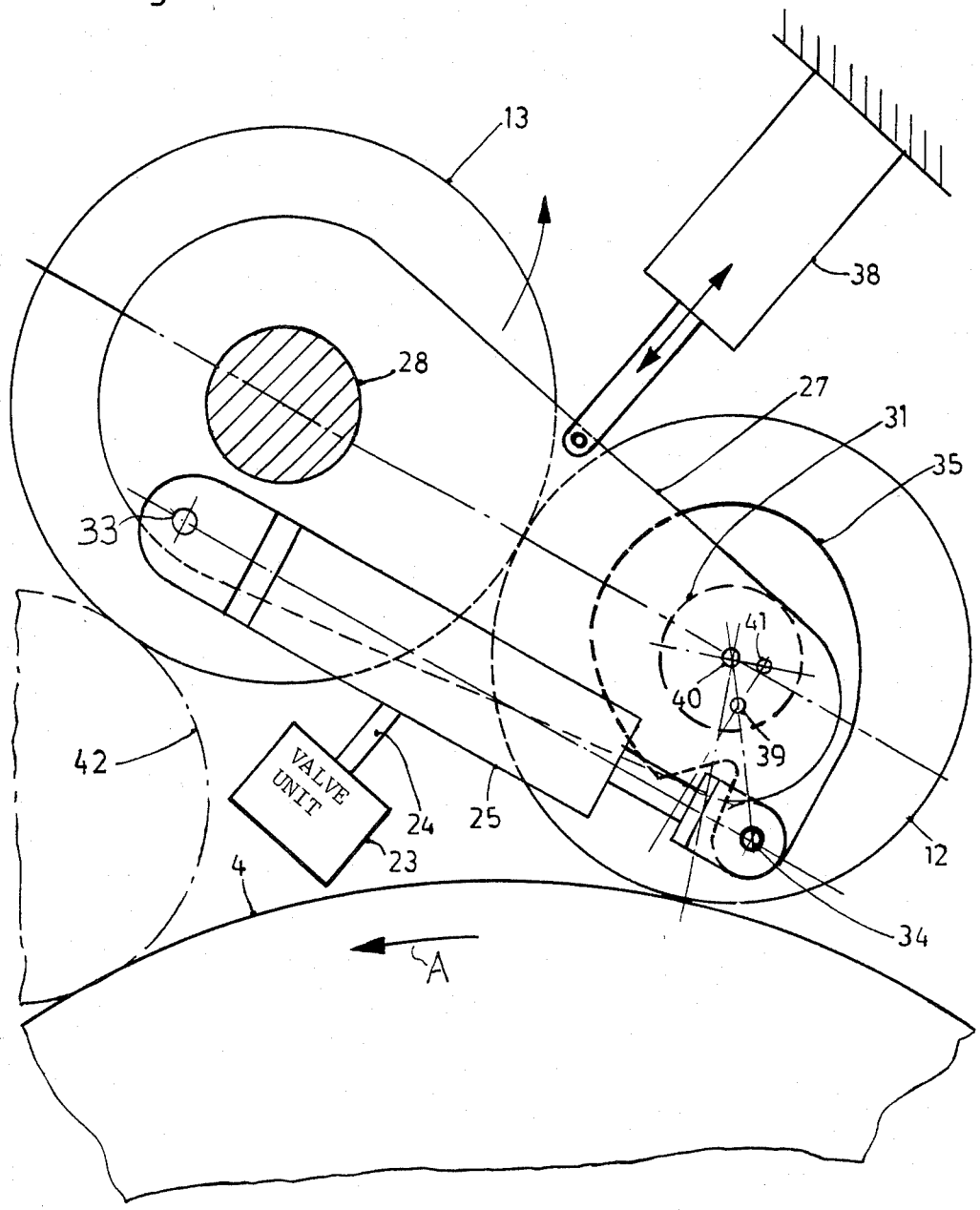
FIG. 2 is an axial end view of a mechanism used in accordance with the invention.
Figure 3:
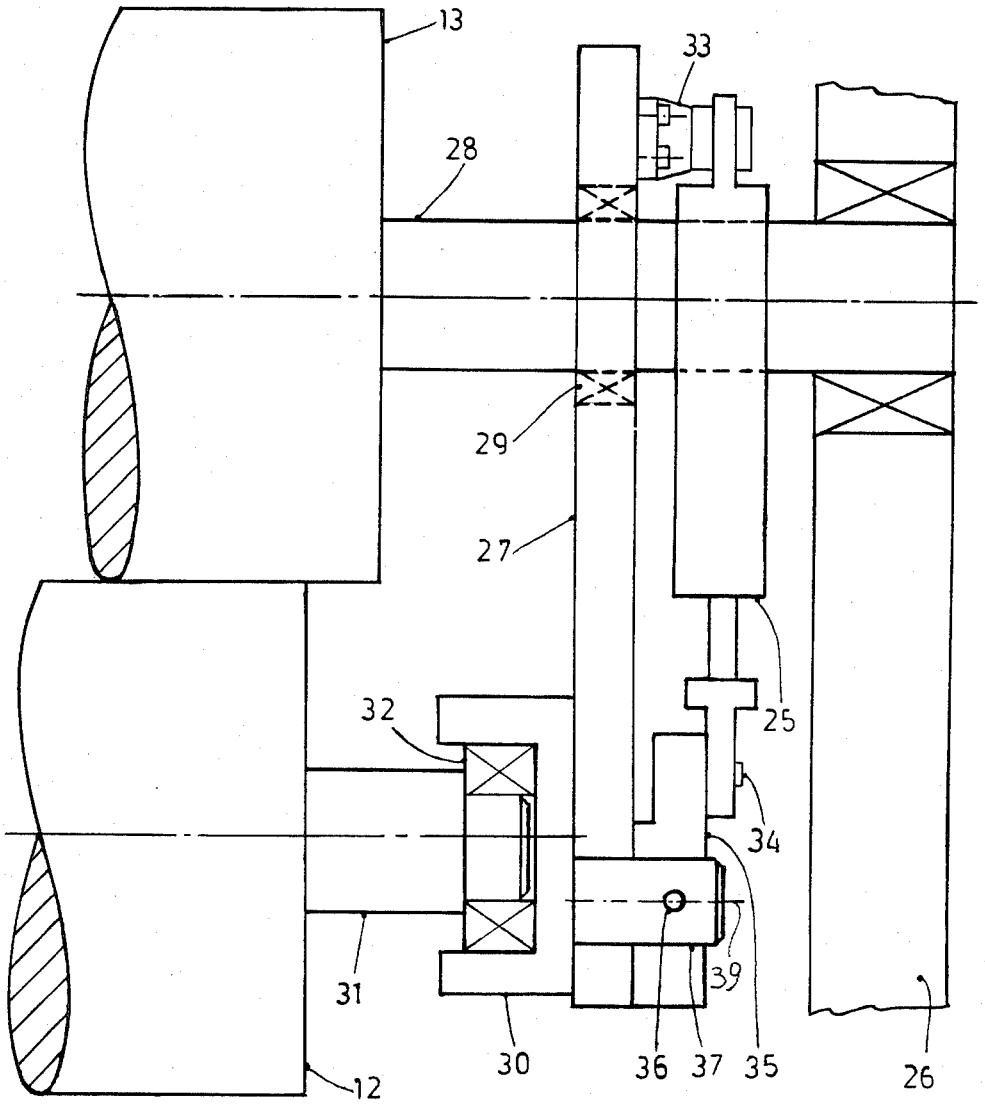
FIG. 3 is a side view of the mechanism of FIG. 2, showing, in fragmentary and schematic representation, those elements important for an understanding of the present invention.

The structure to prevent introduction of paper pieces and scraps into the inker is shown in detail in FIGS. 2 and 3. The ink application roller 12, and the milling roller 13 are supported on a side wall 26 of the frame of the printing machine; a similar arrangement, being the mirror image of that shown in FIGS. 2 and 3, is located at the other side of the cylinders 12, 13, shown only in fragmentary representation in FIG. 3. The side wall 26 is utilized, as customary, for support of the respective cylinders used by the printing machine. A lever 27 is rotatably located on a stub shaft 28 of the milling cylinder 13. A bearing housing 30 is located at the inner side—with respect to the machine, or the rollers or cylinders thereof—of the bearing 27. A bearing 32 is located within the bearing housing 30, positioning a stub shaft 31 on which the ink application roller 12 is rotatably supported.

A pin 33 is located at the upper end of the link or lever 27, the pin 33 supporting the cylinder 25. The piston within the cylinder 25 is secured to a lever 35 by a bolt 34. The lever 35 is secured to a stub 37 which, in turn, is attached to the rear portion of the bearing housing 30. The stub 37 is non-rotatably conected to the lever 35 by a pin 36. The stub 37 is eccentrically positioned with respect to the axis of rotation of the bearing 32 within the bearing housing 30.

A second cylinder 38 is connected with the lever 27—see FIG. 2—in order to permit rocking of the lever 27 about the stub shaft 28, which also defines the axis of rotation of the milling cylinder 13. Upon retracting of the piston of the piston-cylinder arrangement 38 within its cylinder, the ink application roller 12 can be lifted off the plate cylinder 4 while maintaining circumferential engagement with the milling roller 13.

Upon applying of pressure fluid to the piston-cylinder arrangement 25, engaging contact between the ink application roller 12 and the milling roller 13 can be severed. The ink application roller 12 will, however, retain its contact with the plate cylinder 4. Severing engagement of the ink application roller 12 from the milling cylinder 13 is effected upon sensing that the web is torn; this prevents drawing of the torn web 3 into the inker from the plate cylinder.

OPERATION

Let it be assumed that the web 3 is passing from the station 1 to the station 2, and the sensor system 17, 18 detects a tear in the paper. The plate cylinder 4 rotates in the direction of the arrow A. Upon sensing of such a tear, the piston-cylinder arrangement 25 is energized, and engagement between the ink application roller 12 and the milling cylinder 13 is severed. Any torn paper which is carried along the surface of the plate cylinder, for example due to the adhesiveness or stickiness of ink thereon, will be wrapped around the ink application roller 12. This is due to the greater quantity of ink on the ink application roller 12 than the ink which is on the plate cylinder 4. Further, the ink application roller 12, as is customary, will have a soft surface. Consequently, adhesion of the paper about roller 12 will be greater than adhesion of the paper to the plate cylinder 4, so that torn paper will be wound up, or rolled up on the ink application roller 12. The cylinder 38 which, for example, may be pneumatically operated, provides for resilient engagement of the application roller 12 with the plate cylinder 4, permitting the center of rotation of the roller 12 to swing away from the center of rotation of the plate cylinder 4. Thus, the ink application roller 12 may accept several layers of wound paper thereon without damage to the bearings thereof, or possible bending of the roller 12.

As soon as a "paper torn" condition is detected, all rollers of the inker which are in engagement with the milling cylinder 13 are, effectively, out of engagement with the application cylinder 12, and thus paper scraps and the like can no longer be introduced into the inker, or the roller train thereof. Rather, any paper or torn bits thereof will wrap themselves about only a single roller, namely the ink application roller 12. Of course, upon detection of a torn paper condition, the machine also will be stopped as quickly as possible. As soon as the machine is stopped, it is a simple matter to remove all the paper from a single roller, and especially the ink application roller which frequently is accessible, a task which requires substantially less time than cleaning the entire roller train, and all the elements of an inker, including possibly an inking trough, a ductor roller, a doctor blade arrangement and the like.

The lever 35 shown in FIGS. 2 and 3 is formed as a rotary cam or rotary lever, having a swing point or fulcrum located at 39—FIG. 2. As best seen in FIG. 2, the center of rotation of the stub 31 is located at 40, so that the swing or fulcrum point of the lever 35 and the center of rotation of the ink application roller 12 are non-coincident. Upon change in length of the cylinder-piston arrangement 25, the center of rotation of the ink application roller 12 will thus shift to the point 41 which, as is clearly apparent, will cause separation of the surfaces of the milling roller 13 and the ink application roller 12.

Various changes and modifications may be made; the system shown in FIGS. 2 and 3 is particularly suitable for separating an ink application roller 12 from the milling roller 13. Of course, other arrangements may be used to separate the milling roller 13 from the application roller 12. For example, the milling roller 13 may be moved away from the application roller 12, with the relative position of the ink application roller 12 with respect to the plate cylinder 4 remaining unchanged. In the illustration of FIG. 2, for example, the milling roller 13 could be moved upwardly, provided enough space is available within the arrangement of the roller train of the inker.

A further ink application roller 42 is shown, in chain-dotted configuration, in FIG. 2. The further ink application roller 42 is in engagement with the milling cylinder 13. Looked at in the direction of rotation—see arrow A—of the plate cylinder 4, this further in application roller 42 is positioned downstream from the application roller 12. If a plurality of ink application rollers are used, it is usually sufficient to merely sever the first one of the rollers—in the direction of rotation of the plate cylinder—from the associated milling roller 13.

Some systems utilize combined, integrated inker-damper systems, in which damping fluid is supplied via an ink application roller. The present invention is equally applicable to such system and the respective combined ink-damping fluid application roller in contact with the plate cylinder, and being the first one—in the direction of rotation of the plate cylinder—can be arranged for severance from the associated roller supplying ink and/or damping fluid thereto and corresponding, functionally, at least in part to the milling roller 13.

Various changes and modifications may be made within the scope of the inventive concept.

I claim:

1. Rotary printing machine having a plate cylinder (4);

an inker (12–16) applying ink to the plate cylinder including an ink roller train (14–16);

an ink supply roller (13), and an ink application roller (12) in surface contact with the plate cylinder (4) and the ink supply roller (13);

and means (17–24) sensing tearing of paper being supplied to the printing machine and, upon detecting torn paper, providing a "torn paper" signal, comprising, in accordance with the invention, means for preventing damage to the printing machine and transport of torn paper into the ink roller train in case of tearing of paper being supplied to the printing machine, including separating means (25, 30, 35) coupled to the ink application roller (12), controlled by and responsive to a "torn paper" signal from the paper tearing sensing means for removing the ink application roller (12) from contact with the ink supply roller (13) while maintaining resilient yielding engagement with the plate cylinder (4) so as to permit the broken web to wrap around the ink application roller.

2. Printing machine according to claim 1, wherein said separating means for removing the ink application roller (12) from contact with the ink supply roller (13) comprises a pivotable lever (27), pivoting about the axis of rotation of the ink supply roller (13);

a bearing housing (30) receiving a shaft (32) of the ink application roller (12);

a bearing support lever (35) supporting the bearing housing for the shaft (32) of the ink application roller (12), the bearing support lever being linked to the pivotable lever (27);

and a power element (25) connecting the pivotable lever (27) and the bearing support lever (35) at positions remote from at least one of the pivot axes (28, 29) of said levers to change the respective positions of the ink application roller (12) and the ink supply roller (13) and sever surface engagement of the ink application roller and the ink supply roller upon change in dimension of said power element.

3. Printing machine according to claim 1, wherein the ink application roller (12) has a resilient surface.

4. Printing machine according to claim 2, wherein the ink application roller (12) has a resilient surface.

5. Printing machine according to claim 4, wherein said power element comprises a fluid power operated cylinder-piston arrangement.

6. Printing machine according to claim 2, further including a second power element (38) engageable with said pivotable lever (27) for lifting the ink application roller (12) out of engagement with the plate cylinder.

7. Printing machine according to claim 6, wherein the second power element (38) comprises a compressible pressure fluid cylinder-piston unit (38) to apply resilient engagement pressure on the pivotable lever (27) and hence on the ink application roller (12) towards the plate cylinder.

8. Printing machine according to claim 5, further including a second power element (38) engageable with said pivotable lever (27) for lifting the ink application roller (12) out of engagement with the plate cylinder;

wherein the second power element (38) comprises a compressible pressure fluid cylinder-piston unit (38) to apply resilient engagement pressure on the pivotable lever (27) and hence on the ink application roller (12) towards the plate cylinder.

9. Printing machine according to claim 1, further including at least one additional ink application roller (42) located, in the direction of rotation of the plate cylinder, behind said ink application roller (12);

and wherein the means for removing the ink application roller (12) from contact with the ink supply roller (13) is connected only to said ink application roller (12).

10. Printing machine according to claim 1, wherein the rotary printing machine comprises a web-type rotary offset printing machine.

11. Printing machine according to claim 8, wherein the rotary printing machine comprises a web-type rotary offset printing machine.

12. Printing machine according to claim 1, wherein the ink supply roller (13) comprises a milling roller or cylinder.

13. Printing machine according to claim 8, wherein the ink supply roller (13) comprises a milling roller or cylinder.

* * * * *